United States Patent [19]

McKee

[11] 4,185,833

[45] Jan. 29, 1980

[54] GAME APPARATUS INCLUDING CODE CARD, CARD HOLDER AND MATRIX SHEET

[76] Inventor: William D. McKee, 13888 Fremont Pines La., Los Altos Hills, Calif. 94022

[21] Appl. No.: 874,345

[22] Filed: Feb. 1, 1978

[51] Int. Cl.[2] ..... A63F 3/00

[52] U.S. Cl. ..... 273/240; 273/157 R; 273/265; 273/272; 273/282

[58] Field of Search ..... 273/157 R, 240, 265, 273/271, 272, 273; 35/26

[56] References Cited

U.S. PATENT DOCUMENTS

| | | | |
|---|---|---|---|
| 2,044,760 | 6/1936 | Anderson | 35/26 |
| 2,280,609 | 4/1942 | Williamson | 273/157 R |
| 2,481,109 | 9/1949 | Grace | 273/157 R X |
| 3,174,753 | 3/1965 | Miller | 273/157 R |
| 3,545,761 | 12/1970 | Brooks et al. | 273/272 X |
| 4,116,449 | 9/1978 | Breslow | 273/240 |

*Primary Examiner*—Anton O. Oechsle

*Attorney, Agent, or Firm*—Limbach, Limbach & Sutton

[57] ABSTRACT

A game method and apparatus is disclosed wherein an ordered matrix is formed and a representation, such as a letter, word, phrase, symbol or picture, is arranged in a representation matrix corresponding to the ordered matrix. The representation is divided into representation matrix sections each corresponding to a part of the ordered matrix and these sections are arranged in a coded order. The section can be a line, a connecting member, or a member bearing a two dimension reproduction of a portion of the representation. The coded order is followed on parts of the ordered matrix to recreate the representation until the representation is recognized. Game apparatus includes a matrix sheet or board and a coded representation card having a plurality of character combinations, each combination designating part of the coded matrix on the sheet or board and corresponding to a section of the representation to be produced thereon. A card holder is provided having a portion adapted to receive the card and a cover portion covering the representation position of the card.

1 Claim, 31 Drawing Figures

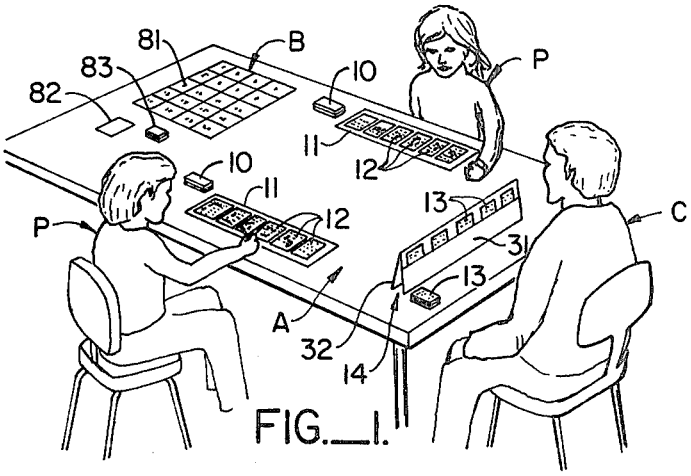
FIG.__1.
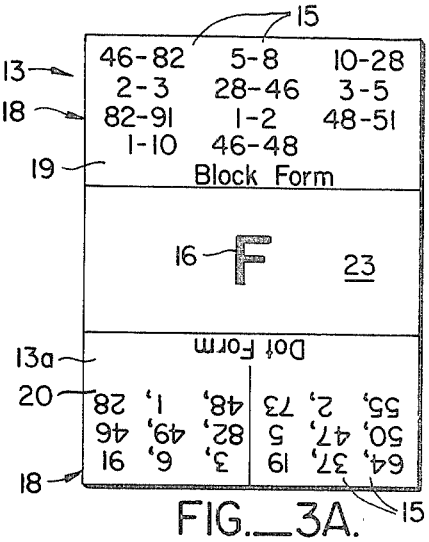
FIG.__3A.
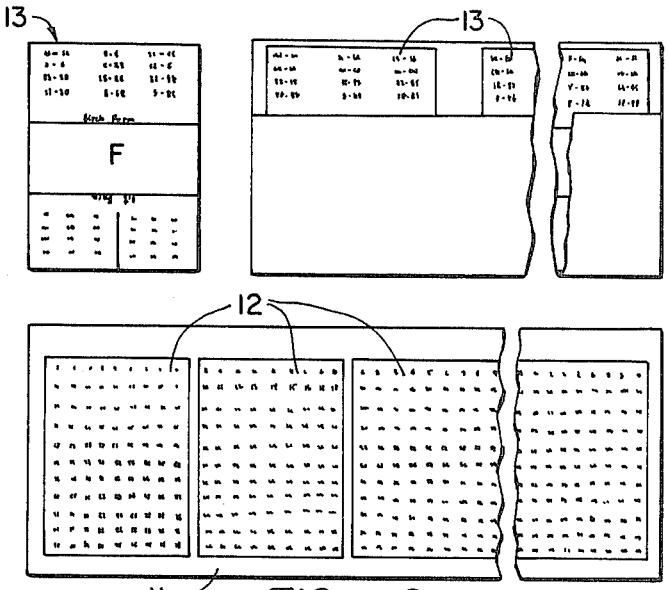
FIG.__2.
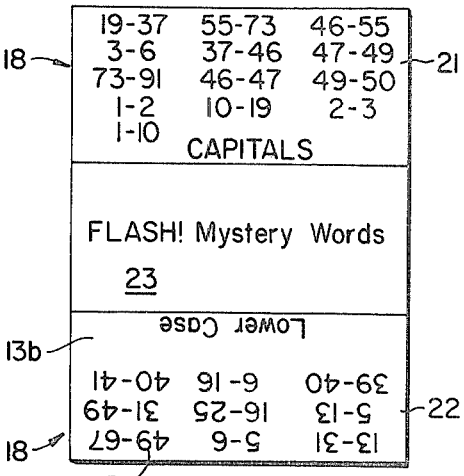
FIG.__3B.
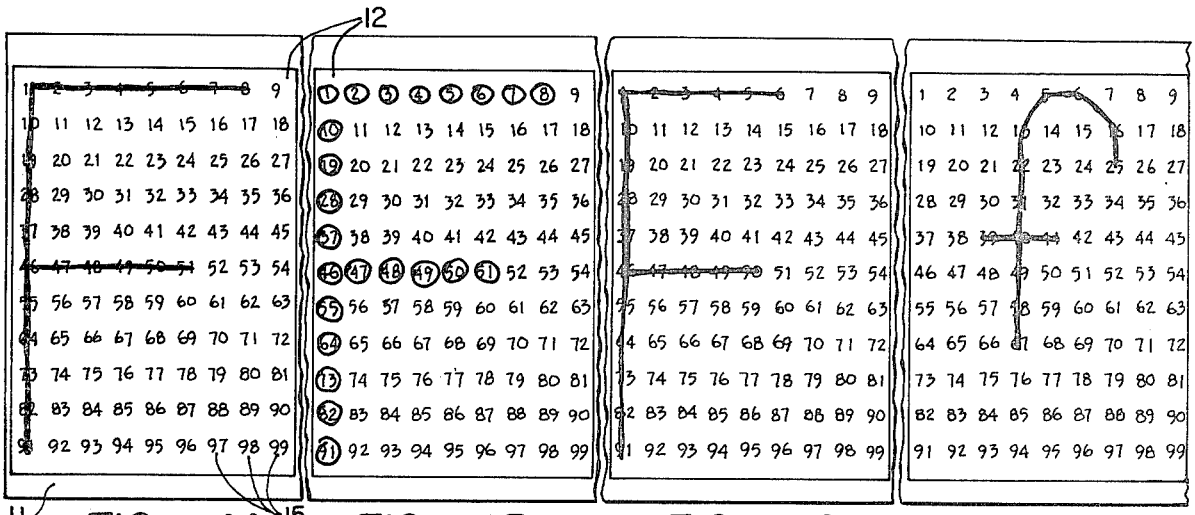
FIG.__4A. FIG.__4B. FIG.__4C. FIG.__4D.
© 1978 W.D. McKEE

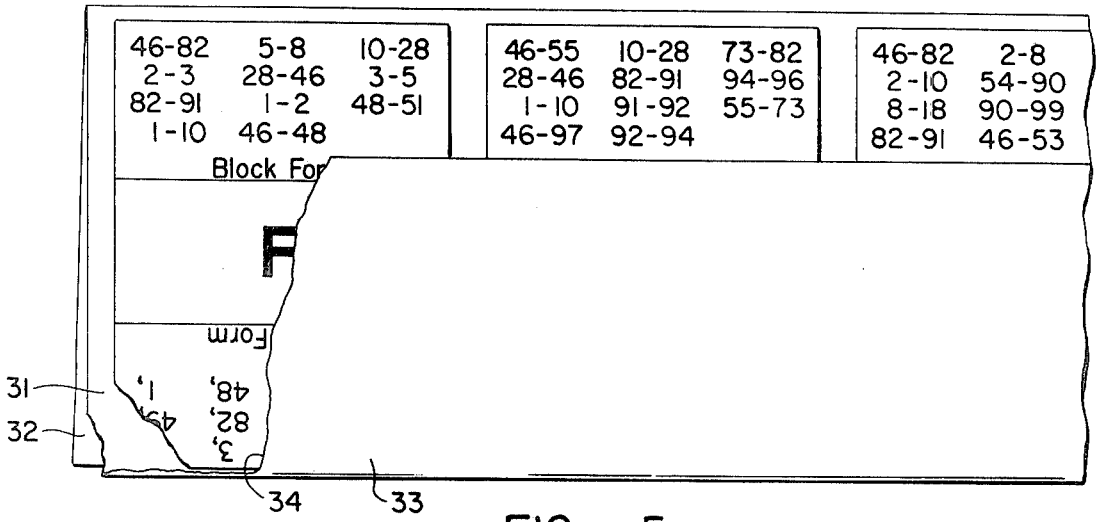
FIG.__5.
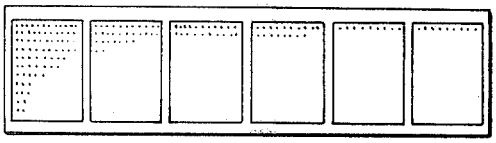
FIG.__6A.
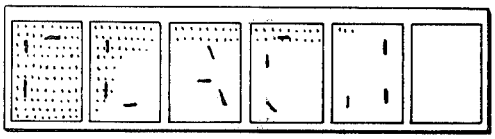
FIG.__6B.
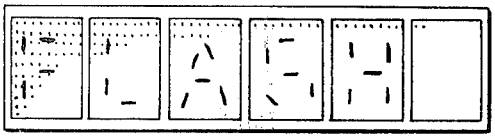
FIG.__6C.
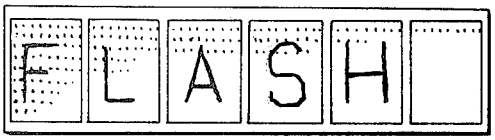
FIG.__6D.
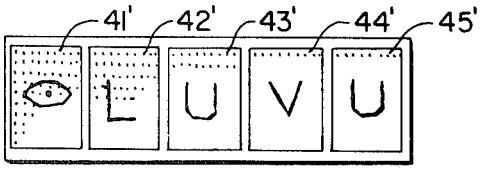
FIG.__7.
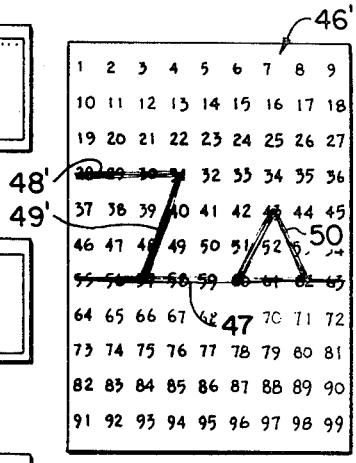
FIG.__8A.
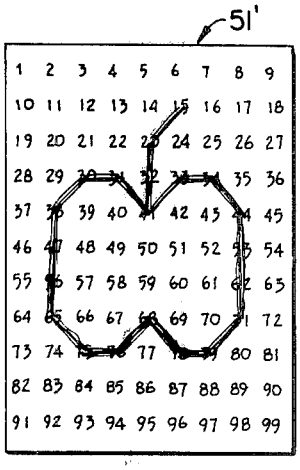
FIG.__8B.
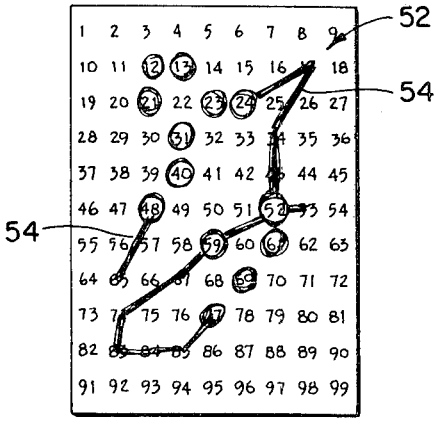
FIG.__9.
© 1978, W.D. McKEE

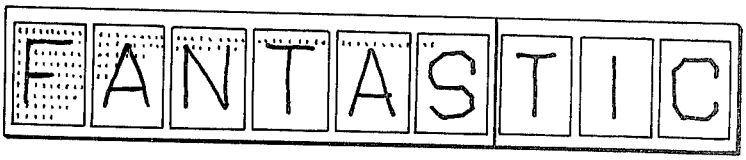
FIG.__10.
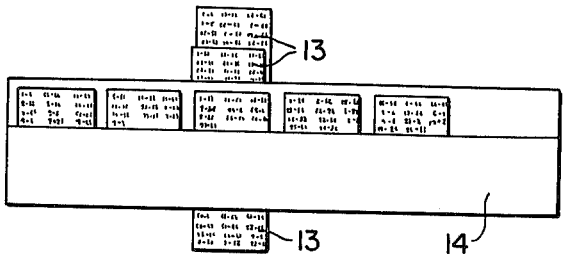
FIG.__11A.
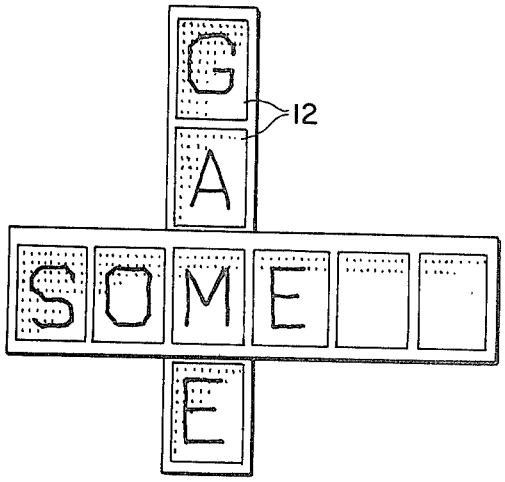
FIG.__11B.
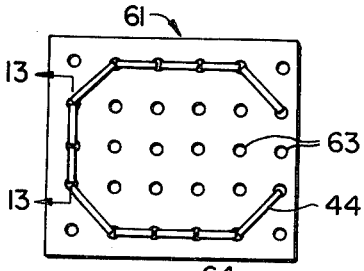
FIG.__12.
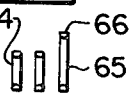
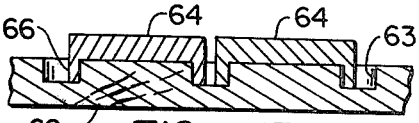
FIG.__13.
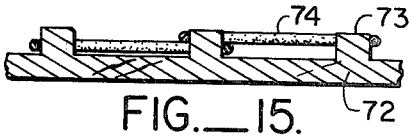
FIG.__15.
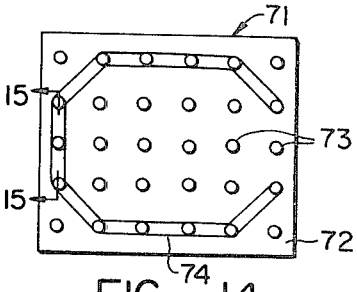
FIG.__14.
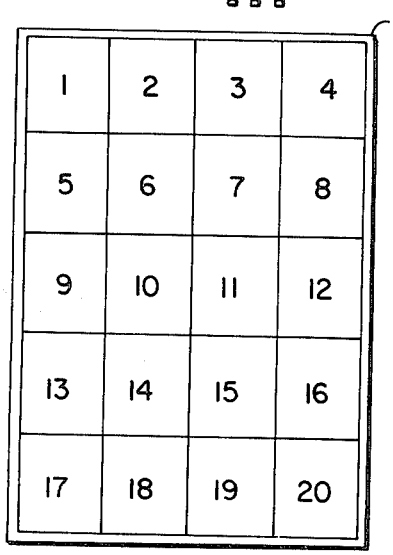
FIG.__16.
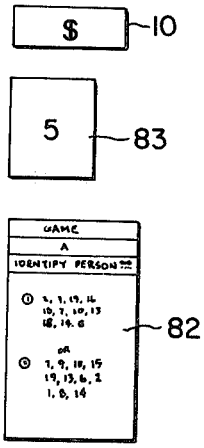
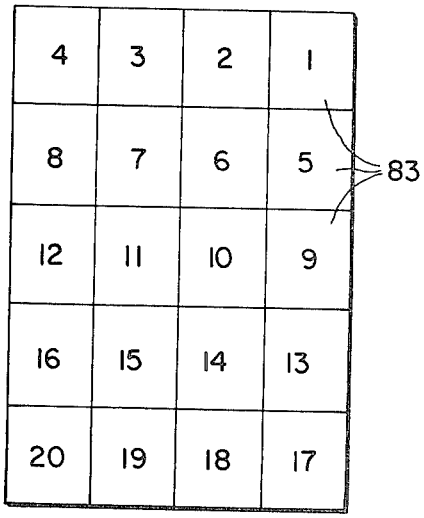
FIG.__17A.

GAME APPARATUS INCLUDING CODE CARD, CARD HOLDER AND MATRIX SHEET

The present invention relates to a recognition game method and apparatus based upon the use of a method and apparatus until a repesentation such as a letter, word, phrase, symbol, picture or the like being recreated is recognized.

BACKGROUND OF THE INVENTION

Dot and line games, pictures and puzzles are well known wherein numbered dots and lines are connected to form a picture or representation. In one known game the outlining portion of a representation such as the picture of a person, animal or object is replaced by spaced apart dots given sequential numbers. A line is drawn from numbered dot to numbered dot in sequence to redraw the outline of the representation. Another game called "boxes" is played on an unnumbered rectilinear dot matrix by players successively connecting adjacent dots to see which player can be responsible for "closing" the most boxes which are defined by dots on the corners of a square.

Another known dot and line game is the game often called "battleship" played with an identical pair of numbered matrices of dots wherein one player "hides" one or more lines or shapes such as representing ships, in his matrix and the other player calls out the dropping of bombs on numbered dots to "bomb" the ships.

In these prior art games the lines are created on the matrix by reason of information on the matrix as is the case of the lines connecting dots as the outline of an object or are created by direction of the player's thought processes as in the case of the "boxes" and "battleship" games.

It is the object of the present invention to provide a game method and apparatus keyed to a coded order of sections of a representation in order to redevelop the representation on an independent matrix by following the coded order until the representation is recognized, typically short of full reproduction of the representation. The term "representation" is used herein to mean the perceptible illustration, be it one or more letters, words, phrases, symbols, pictures or combinations thereof, that are recreated during the game and to be recognized during the recreation.

Broadly stated the present invention is directed to a method and apparatus of first forming an ordered matrix and then establishing a representation arranged in a representation matrix corresponding to that of the ordered matrix. The representation is then divided into representation matrix sections corresponding to parts of the ordered matrix and these sections are established in a coded order so that by following the coded order on parts of the ordered matrix the representation is recreated until the representation is recognized.

In accordance with one aspect of the present invention the coded order is followed to recreate the representation by covering the representation sections on corresponding parts of the ordered matrix. This feature can be accomplished using arbitrarily shaped tokens to cover parts of the matrix wherein the representation will appear in the configuration of the tokens. This feature can also be accomplished by utilizing two dimensional physical reproductions of portions of the representation on parts of the ordered matrix wherein the representation will then be recreated by the appearance of the separate portions together. One example of this latter aspect is a representation in the form of a picture of a famous person, place or scene subdivided into pieces shaped to conform to the shape of the parts of the ordered matrix and wherein parts of the representation can include legends defining characteristics of the representation, such as physical or historical facts regarding the representation in the picture. As the picture is recreated on the matrix by following the coded order certain of these legends will appear as the parts of the pictures are fitted together so that more and more information is established regarding the characteristics of the repesentation as the sequence is followed until enough information is provided for recognition of the repesentation.

In accordance with another feature of the present invention the coded order is followed by joining parts of the ordered matrix, such as by connecting separated parts of the matrix. In accordance with this feature of the invention the sections of the representation are recreated by the joined parts of the matrix with lines or connecting members in line form. In accordance with this feature of the invention the representation can be one or more letters or symbols to form a design or word which can be recognized as the sections of the letters or symbols are recreated together.

Another feature of the invention is the provision of game apparatus including a sheet provided with at least one ordered matrix and at least one coded representation card having at least one coded portion made up of a plurality of character combinations, such as numbers, letters, or combinations thereof. Each character combination designates a part of the coded matrix on the sheet and a section of the representation to be reproduced. In accordance with one aspect of this feature of the invention a coded card is provided for each letter in the alphabet of a language. In accordance with another feature of this aspect of the invention the coded card includes a repesentation portion on which the representation is reproduced and a card holder is provided for the game having a portion adopted to receive and support the card exposing the coded portion and having a cover portion covering the representation portion when the card is supported in the holder.

Other features and advantages of the present invention will become apparent upon a perusal of the following specification taken in conjunction with the accompanying drawings wherein similar characters of reference indicate similar structures in each of the several views.

BRIEF DESCRIPTION OF THE DRAWINGS

FIG. 1 is a schematic perspective view illustrating the parts making up the different aspects of the present invention and illustrating generally how they may be used.

FIG. 2 is a plan view illustrating parts of the present invention illustrated in FIG. 1 and illustrating one embodiment of the present invention.

FIGS. 3A and 3B are front and back views, respectively, of a representation card as shown in FIG. 2.

FIGS. 4A–D are plan views of matrix sheets onto which letter representations have been created from the coded order found on the different portions of the representation card illustrated in FIGS. 3A and 3B.

FIG. 5 is an enlarged elevational view, partially broken away, illustrating the use of game pieces shown in FIG. 2.

FIGS. 6A–D are plan views of the matrix sheet of one embodiment of this invention and illustrating how the representation is created thereon.

FIG. 7 is a view similar to FIG. 6D illustrating another embodiment of the present invention combining the use of symbols and letters in playing the game.

FIGS. 8A and 8B are views similar to portions of FIG. 7 illustrating other aspects of the present invention.

FIG. 9 is a view similar to FIGS. 8A and 8B illustrating still another embodiment of the present invention.

FIGS. 10 and 11A and 11B are figures illustrating different arrangements of the card holders and matrix sheets of the present invention to illustrate different word recognition games.

FIGS. 12 and 14 are plan views of other embodiments of this invention with FIGS. 13 and 15 being elevational section views of FIGS. 12 and 14 respectively taken along lines 13—13 and 15—15.

FIG. 16 is an elevational view showing the game pieces of another embodiment of the present invention.

FIGS. 17A and 17B are views showing the back and front, respectively, of the picture sections shown stacked up in the embodiment of FIG. 16.

DETAILED DESCRIPTION OF THE PREFERRED EMBODIMENTS

Figure 17B:
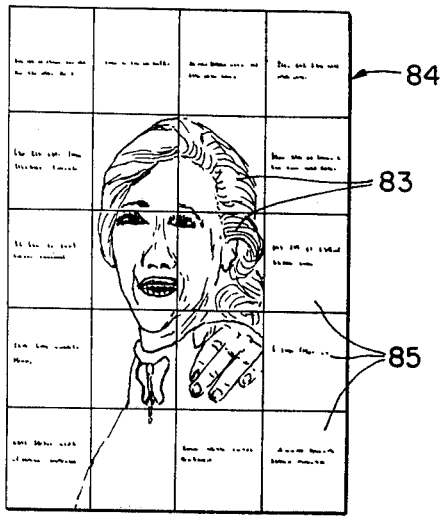

While the present invention is applicable to the game method and apparatus described in various forms and following various embodiments, it is especially suited for the recreation of a representation such as a letter, word, symbol, phrase or picture through a coded sequence of steps wherein sections of the representation are created on a matrix until the representation is recognized. While the invention can be utilized with a single letter or character it can also be utilized in the creation of a plurality of letters making up a word which is harder to recognize than a single letter or character. Accordingly, the invention will first be described with respect to FIGS. 1–6 for the creation of a word for recognition.

Referring now to the drawing with particular reference to FIGS. 1–6, there is shown a preferred embodiment of the present invention directed to the game method and apparatus. In FIG. 1, embodiments A and B of the invention are illustrated as laid out between two players P and a caller C utilizing the game apparatus to follow the game method. The game apparatus generally designated as the collection A includes boards or sheets 11, each having a plurality of ordered matrices 12 thereon, coded representation cards 13 typically including several cards representing each of the letters of the alphabet, a card holder 14 for each of the players and game currency 10. On the sheet 11 particularly illustrated are five ordered matrices 12.

As illustrated in greater detail in FIGS. 2 and 4 each matrix includes a series of characters 15, preferably numbers arranged in sequential order in a rectilinear array. The numbers are arranged in sequence beginning at the top lefthand corner of the matrix and running in horizontal rows across the matrix, the second row having at its lefthand end a number continuing from the number sequence ending at the righthand end of the preceding row. It will be appreciated that other grids or matrices using a different arrangement of numbers or letters can be utilized or a matrix can be provided by numbers or letters designating the coordinates of a spot on the sheet such as the intersection of horizontal and vertical lines or rows and columns. The numbers designate different parts of the matrix which can be considered either the area including and surrounding a number or the area between or the line between two designated numbers or characters.

In the embodiment of FIGS. 1–6 the sheet 11 is provided with five matrices 12 to produce a representation 16, in this case a letter, in each matrix. In the drawings to distinguish between the original representation and the representation as it is being recreated, the original representation itself will be designated with the plain number, such as 16, while the representation being recreated or once recreated will be referred to by a prime number, such as 16'.

As shown in greater detail in FIGS. 3A and 3B, the coded representation cards 13 contain at least one coded portion 18 containing indicia or the like in the form of character combinations identifying representation matrix sections corresponding to parts of the ordered matrix. The representation 16 has been arranged in a matrix or rectilinear array corresponding to that of the ordered matrix and then subdivided into these representation matrix sections corresponding to parts of the ordered matrix and with which the representation will be recreated on a matrix. The character combinations 15 defining the different representation matrix sections are arranged in a coded order designed to conceal the identity of the representation for a substantial time as the representation is being recreated.

In the particular preferred embodiment shown in FIG. 3 the coded representation card 13 contains four different coded portions 19, 20, 21 and 22 in each of which is provided a different sequence of character combinations 15 for recreating the particular representation, which in the case of FIG. 3 is the alphabetical letter "F". In FIG. 3A which shows the front 13A of the card 13, a coded portion 19 at the top of the card 13A includes character combinations for recreating the repesentation "F" in a block letter form. At the bottom of the front of the card 13A in coded portion 20 and printed in character combinations 15 upside down with respect to those at the top of the card in coded portion 19 are character combinations 15 for recreating the representation 16 in dot form. When the card 13A is rotated 180-degrees so that coded portion 20 is at the top of the card, the character combinations in coded portion 20 will be right side up. FIG. 3B illustrates the back 13B of the card 13 where the character combinations 15 in the coded portion 21 at the top of the card 13B are provided for reproducing the letter "F" representation 16 in capital letter form, and the character combinations 15 in the bottom coded portion 22 are provided for recreating the letter "F" in lower case form.

The particular coded representation card 20 shown in FIGS. 3A and 3B also includes on the front the printed letter "F" which is the actual representation 16 that is to be recreated with this coded representation card 13. In certain embodiments of the present invention as will be described in greater detail below, the actual representation 16 is not provided on the coded representation card 13 so as not to give away the representation to persons playing the game. However, in the embodiment of the present invention shown in FIGS. 1–6, the coded representation card 13 is typically used in conjunction with the card holder 14 wherein the representation "F" on the card 13 will be concealed by the card holder 14.

The upper coded portions 19 and 21 and the lower coded portions 20 and 22 each occupy approximately one-third of the length of the card 13 leaving a central portion 23 which, in the preferred embodiment illustrated in FIGS. 1–6 includes the representation 16 to be recreated and the information, such as "block form", "dot form", "capital" and "lower case" which define the form in which the letter representation will be recreated in accordance with the coded character combinations 15 found on portions 19, 20, 21 and 22, respectively, of the card.

The card holder 14 (see FIGS. 1, 2 and 5) includes a front angularly upstanding face 31 supported by a back support member 32, with the front and back members 31 and 32 joined at their top, such as being formed from a single cardboard sheet folded along a line which results as the top of the card holder 14. Other structures can be utilized, such as a front upstanding face member made of plastic with a folded under base portion which supports the front face in an angled manner for viewing as shown in FIG. 1. The card holder 14 also includes a cover portion 33 extending substantially two-thirds of the distance up the front upstanding face 13 so that the cover portion 33 forms a pocket 34 with the lower two-thirds of the front face 31 for holding the coded representation cards 13 with the lower two-thirds of each card 13 in the pocket 34 and the top one-third of the card 13 exposed for viewing the coded portion 18. As can be seen from FIG. 5, this construction of the card holder 14 permits the coded representation card 13 to be positioned in the pocket 34 hiding both the central portion 23 of the card 13 and the lower coded portion and leaving the upper portion of the card containing the desired coded portion to be used exposed for viewing by the game player.

With the structural elements of the game now described the method of playing the game in accordance with a preferred embodiment illustrated in FIGS. 1–6 will be described. With three or more players one player is chosen as the caller C who secretly makes up any mystery word and selects from the stacks of coded representation cards 13 the appropriate card for each letter of the word. For convenience he arranges these cards in the card holder 14. He is able to select for each of the letters the particular form in which he wishes the letter to be recreated, i.e. block form, dot form, capital or lower case. If he selects the dot form, the players are instructed that the game will be played in dot form so that in recreating the representation 16′ on their matrix sheets 11 the players will be covering up parts of the ordered matrix 12 such as the area of and surrounding a given number on the matrix 12. The covering step can be accomplished either by placing an arbitrarily shaped token, such as a disk over the number, or by blocking out the number with an implement such as a pencil, pen or crayon.

If the game is played using the block form, capitals or lower case, the representation is recreated on the matrix sheet by joining parts of the ordered matrix to represent sections of the representation 16′. An illustration of recreating the representation in block form is progressively illustrated in FIGS. 6A–6D. Before commencement of the game each player typically anties up a designated amount of game currency. The caller C then reads designated character combinations 15 from the coded representation cards 13 which have been placed in the card holder 14. Typically the caller would read the top row of character combinations 15 from each code card 13 in the holder 14, and with each character combination 15 called out, each player P will connect those character numbers on the appropriate matrix 12 on his matrix sheet 11. For example, he will connect numbers 46 and 82, 5 and 8, and 10 and 28 in the first matrix ultimately for the first letter "F"; then numbers 46 and 55, 10 and 28, and 73 and 82 in the second matrix for the letter "L", etc. as shown in FIG. 6B. The caller C then reads across the second row of character combinations 15 of each of the cards 13 and continues until one of the players first believes he recognizes the developing word and calls out a designated expression to stop the game. He adds an amount of currency to the currency pot and guesses the word. If he is correct he wins all the currency thus far segregated. If he is incorrect the game continues until he or another player again stops playing by calling the designated expression. If the game were carried to completion using all the code numbers the mystery word would appear as shown in FIG. 6D.

FIGS. 4A–4D illustrate how the letter "F" would be formed on the matrix sheet in each of the four different forms. FIG. 4A illustrates the letter established in block form; FIG. 4B illustrates the letter established in dot form; FIG. 4C illustrates the letter in capital form; and, FIG. 4D illustrates the letter in lower case form. With many letters of the alphabet like the letter "F" the block form and the capital form may take the same configuration.

Instead of the representation being a word as illustrated in the embodiment of the invention shown in FIGS. 1–6, the representation can be a phrase, either in letters alone, symbols, or a combination of the two as shown in FIG. 7, a drawing such as shown in FIG. 8A and 8B or a single letter as shown in FIG. 9. In FIG. 7 the representation 41′ in the first matrix is a picture of an "eye" followed in the next four matrices by representations 42′–45′ of the letters "L", "U", "V" and "U" to represent the phrase "I LOVE YOU". In FIG. 8A the drawing 46′ is a droodle in the form of a straight line 47′ provided at the lefthand margin of the matrix with a horizontal line 48′ provided from its righthand end with a line 49′ angling downward and leftward to the straight line 47 and an inverted "V" 50′ to the right to represent "a ship arriving too late to save a drowning witch". In FIG. 8B the representation 51′ is the outline of an apple and in FIG. 9 the partially completed representation 52′ is the letter "G" in script form.

There is a separate code card for the representation 41′ of the "eye" in FIG. 7 and for the representations 46′, 51′ and 52′ in FIGS. 8A, 8B and 9. With the representations shown in FIGS. 7, 8 and 9, the game can be played in the same manner as described above with reference to FIGS. 1–6.

For playing the game without a caller C and without a card holder 14 the code card 13 for each representation 16 is provided with a key number keyed to a master list which identifies the representation for each key number so that by reading the key number on the code card 13 and then referring to the master list, or vice versa, the representation for the particular coded character combination on the code card can be known.

A second method of play with the representations described with reference to FIGS. 7 and 8A and 8B and wherein the code card does not identify the representation is for each player to select one or more code cards from a group of code cards working from the code cards or the master list. When the code cards have been identified the player passes the code card to another player. Then each player using the code card or cards provided to him races to complete a representation on his matrix sheet to be the first one to recognize the representation as it develops.

The players or the caller may form their own letters on matrix sheets and code them on a separate piece of paper. This provides the challenge of unusual shaping and coding of letters such as the script "G" shown in FIG. 9. The caller then calls his code directly from his matrix by first marking the representation 52' by a line 53 and then marking the segments 54 of the representation in a different color or a heavier line to keep track of the segments of the representation as he calls them out.

Longer words can be formed by arranging the card holders one on top of another as illustrated in FIG. 10, and one or more intersecting words, even to the formation of a crossword puzzle, can serve as the entire representation to be recreated by aligning one or more card holders 14 and code cards 13 in an intersecting manner as shown in FIG. 11A with instructions to the players to arrange their matrices in an intersecting manner as shown in 11B. If the code cards were such as shown in FIG. 3 including the identity of the representation, the caller would cover up that portion of any coded card 13 showing the representation.

In accordance with the present invention the step of following the coded order on parts of the matrix 12 to recreate the representation 16' on the ordered matrix 12 can be accomplished by drawing on the matrices 12 as shown in FIG. 6 or by joining appropriate parts of the matrix as shown in FIGS. 12–15. In the embodiment illustrated in FIGS. 12 and 13 the matrix 61 includes a board member 62 provided with holes or recesses 63 arranged in a rectilinear array and containing identifying numbers in the same manner as described above. Connecting members 64 and 65 are provided for joining recesses with each connecting member 64 and 65 having a downwardly projecting extension 66 at the opposite ends thereof to fit into part of the recess 63 and hold the extension members in place. The surface of the downwardly projecting extensions 66 facing one another from opposite ends of the connecting members 64 and 65 are rounded so as to conform to the rounded cylindrical surface of the recesses 63 as illustrated with respect to the connecting members 64 and 65 positioned beside the board member 62 in FIG. 12. It will be appreciated that for extension members to connect recesses on the sides as well as on the diagonals of the rectilinear array, two different length connecting members will be required. Thus, connecting member 64 is provided of a length to connect recesses along an edge of a square formed by recesses 63 in the board member 62, and connecting member 65 is dimensioned to join recesses 63 along a diagonal of a square in the rectilinear array.

Referring now to FIGS. 14 and 15 there is shown an alternative embodiment of the present invention wherein the matrix 71 is formed of a board member 72 having upwardly projecting cylindrical stub portions 73 with the stub portions 73 arranged in the rectilinear array. Each of the stub portions can be provided with its identifying number on the top of the stub portion or alternatively defined by its coordinates if a coordinate system is used for the ordered matrix of the game. In the embodiment of FIGS. 14 and 15 the connecting members are elastic loops 74, such as rubberbands, which can be stretched between and looped over a pair of stub portions 73. Since the elastic connecting members 74 will stretch, a single size of loop 74 can be provided for stretching between several pegs arranged along an edge of the rectilinear array or arranged on a diagonal of the rectilinear array.

Referring now to FIGS. 16–19 of the drawing there is illustrated another embodiment of the present invention previously referred to by letter B in FIG. 1 and wherein the game apparatus comprises a sheet or board 81 divided into square areas by a matrix with each square area numbered in a sequence of numbers in rows and columns in the same general pattern as the numbers referred to in the previous embodiments. A code card 82 is provided with character combinations defining a coded order for the representation sections 83 from the representation 84 to be reproduced. In this embodiment of the present invention the representation 84 is divided into sections 83 which correspond to sections of the matrix and are provided in an appropriate place, such as on their back sides, with a number correlating the section 83 to the corresponding part of the ordered matrix of the matrix board 81. The front and back of the representation sections 83 which go to make up the representation 84 are shown in FIGS. 17B and 17A where the sections 83 are assembled in the same ordered matrix as provided by the matrix board 81. The representation sections 83, as a whole as shown in FIG. 17B, provide the representation 84 which is to be recognized.

At least certain of the representation sections 85 include informative data regarding the representation that is to be recognized. In accordance with this aspect of the invention the representation sections are placed on the matrix board 81 sequentially in the coded order provided on the coded card to establish the representation 84' in front of the game player until the representation is recognized, hopefully before the final representation section is put in place.

Figure 18A:
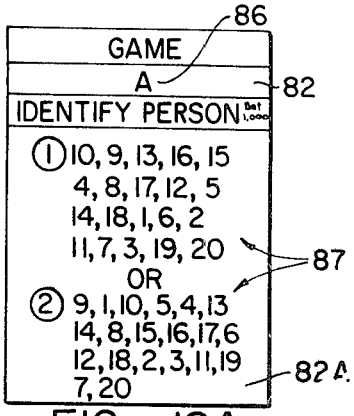
FIGS. 18A and 18B are front and back views, respectively, illustrating the coded card shown in FIG. 16.
Figure 18B:
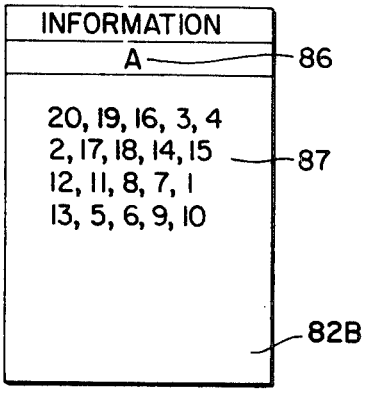

The front and back of the code card, 82A and 82B respectively, are illustrated in FIGS. 18A and 18B respectively. The front 82A of the code card contains a key letter or number 86 for identification of the particular representation on a master list (not shown) as well as one or more coded sequences 87 which can be utilized to reproduce the representation on the matrix board 81. The code that is selected is designed slowly to reveal information to the player by both pictorial as well as written information. On the back of the code card the code numbers for just the information containing sections 85 for the representation 84 are listed in the event the players wish to change the coded order and select just the representation sections 85 which contain the informative data.

The method of playing the recognition game according to the embodiment of FIG. 16–19 can include provision for recognition of more than one feature. For example if the representation includes a picture of an individual located in a specific scene, the recognition game can include questions for recognition of the individual and aspects of the scene such as the country, the city, and specific buildings appearing in the background of the scene. In playing the game the player will make a bet each time he believes he has recognized one feature.

Figure 19A:
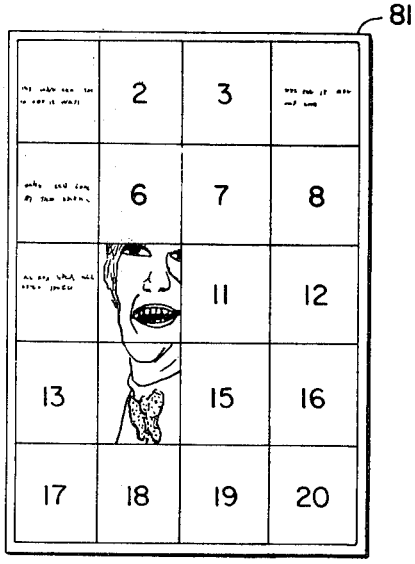
FIGS. 19A and 19B are views of the ordered matrix of FIG. 16, respectively, partially completed with the picture sections such as shown in FIGS. 17A and 17B.
Figure 19B:
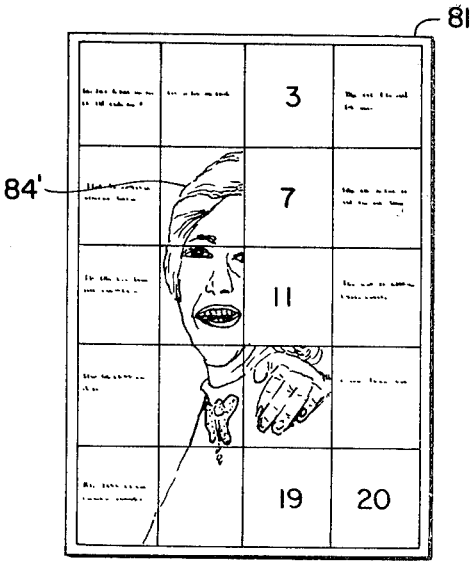

FIGS. 19A and 19B illustrate steps in the process of playing the game. In the FIG. 19A the second code given on the code card 82 has been followed to produce a number of representation sections 83 including certain the the representation sections 85 containing written data and in FIG. 19B an additional number of sections have been added so that the representation 84' is now more recognizeable.

It will be appreciated from the foregoing that there can be many alternatives and modifications to the recognition game method and apparatus herein described. The games can be played by individuals or teams of individuals. Different players and/or different players on each team can be given the task to develop the representation from either the top or the bottom of the matrix. Beside the suggested procedure of following a coded order for turning over and placing the representation sections 83 on the matrix board 81, the sections can be turned over in a random fashion controlled by the player or by a roulette wheel, rolling dice or blind draw. Additionally the sections and matrices can be a standard size and shape or of various sizes and shapes such as a jigsaw puzzle arrangement. Additionally the representation may be a target in which each section is turned over when it is hit by objects such as balls, darts or bean bags and the section of the picture can be revealed by removing its cover when it is hit. Additionally the matrix board may have areas of different density whereby finer details to the representation can be created in areas of greater density.

Also, in order to do away with the necessity for a master list and still hide the identity of the representation from the player who is working with the coded representation card, a removable covering member can be provided on the portion of the coded representation card where the identity of the representation is found.

What is claimed is:

1. Game apparatus comprising, in combination;

a sheet provided with at least an ordered matrix, at least one coded representation card having at least one coded portion made up of a plurality of character combinations, each character combination designating part of said coded matrix on said sheet and each character combination coresponding to a section of a representation to be reproduced on said ordered matrix, all of said character combinations translatable onto said sheet thereby establishing said representation on said sheet said card including a representation portion on which said representation is reproduced and which is separate from the coded portion and a card holder having a portion adapted to receive and support said card with the coded portion exposed and having a cover portion covering said representation portion of said card when said card is supported on said holder.

* * * * *